US005857885A

United States Patent [19]

Laou et al.

[11] Patent Number: 5,857,885

[45] Date of Patent: Jan. 12, 1999

[54] METHODS OF FORMING FIELD EMISSION DEVICES WITH SELF-ALIGNED GATE STRUCTURE

[76] Inventors: Philips Laou, 4980 Langelier, Montreal, Quebec, Canada, H1M 2A1; Ishiang Shih, 3300 Bahama St., Montreal, Quebec, Canada, J4Z 2R4

[21] Appl. No.: 743,279

[22] Filed: Nov. 4, 1996

[51] Int. Cl.[6] ..... H01J 9/02

[52] U.S. Cl. ..... 445/24; 445/50

[58] Field of Search ..... 445/24, 50

[56] References Cited

U.S. PATENT DOCUMENTS 5,389,026 2/1995 Fukuta et al. ..... 445/24

5,458,518 10/1995 Lee ..... 445/24

*Primary Examiner*—Kenneth J. Ramsey

[57] ABSTRACT

Methods of forming a field emission device with self-aligned gate structure, comprising a substrate on which at least one wedge or tip electrode and one accelerating or gate electrode are provided. The only photolithographic step involved is to pattern an integrated gate electrode opening on high quality, thermally grown oxide which can withstand a strong electric field. The formation of the emissive electrode by etching starts at the edge of the integrated gate electrode opening defined by the oxide material layer. As a result, the distance between the emissive electrode and the gate electrode is minimum. Simple wet chemical etching may be used to form the emissive electrode.

10 Claims, 4 Drawing Sheets

METHODS OF FORMING FIELD EMISSION DEVICES WITH SELF-ALIGNED GATE STRUCTURE

FIELD OF INVENTION

The invention consists of a method of forming a field emission device with self-aligned gate structure, comprising a substrate on which at least one wedge or tip electrode and one accelerating or gate electrode are provided. More specifically, this invention entails the fabrication with only one photolithographic step of a field emission device.

BACKGROUND OF THE INVENTION

The field emission device consists of a cathode or emitter electrode, a gate or accelerating electrode and an anode or collector electrode. In general, the distance between the emitter and the accelerating electrodes is extremely small—in the order of one micron or less. As a result, a small voltage applied between the two electrodes generates a strong electric field. Electrons are emitted from the emitter electrode under the action of a strong electric field, a process called field emission. The difference between field emission and thermionic emission is that in thermionic emission, electrons are emitted from a hot electrode as a result of the heat. Hence the kinetic energy of the electrons is higher than that of the potential barrier between the electrode material and the vacuum. In field emission, electron emission is caused by a strong electric field so that a hot emitter electrode is not required. Thus the major advantage of field emission over thermionic emission is that a small electron source unit without the heating element can be constructed.

There are several prior art methods which can be used to fabricate silicon field emission devices. One method is to start with a silicon substrate, 1, on which silicon dioxide islands, 2, with a diameter of say 1 micron are patterned (FIG. 1). A silicon etching process is carried out until the diameter of silicon under each oxide island, 3, is in the order of 0.2 micron, with the oxide islands being used as an etching mask (FIG. 2). A dielectric layer, 4, of 0.3 micron thickness, for example, silicon dioxide or silicon nitride, is deposited by thermal evaporation or chemical vapour deposition on the entire substrate (FIG. 3). This layer will cover the top of the oxide island and around the oxide islands but will not trickle beneath the oxide islands. A second silicon etching process is carried out and a tip emitter electrode, 5, is formed. A layer of metal, 6, such as aluminum or chromium, is then deposited on the entire surface (FIG. 4). As a result, the metal sitting on the dielectric layer acts as the gate or accelerating electrode.

This prior art method does not require a photolithographic alignment process, however, the breakdown voltage of the dielectric layer deposited by thermal evaporation or chemical vapour deposition is not as high as that of thermally grown silicon dioxide. Therefore, a field emission array fabricated using the above method is not efficient enough for long term device operation. If an electrical breakdown between the gate and the substrate occurs, the corresponding field emission device becomes defective. It is thus highly desirable to develop a process which utilizes thermally grown oxide as the insulator between the gate and substrate.

OBJECTIVES

The fabrication process for a field emission device involves micromachining and photolithography. Due to the small physical size of each device, it is difficult to fabricate a large array of field emission devices using a fabrication process involving two, or more photolithographic alignment steps. One objective of this invention is to provide a field emission device fabrication process which requires no photolithographic alignment. The only photolithographic step involved in this invention is to pattern an integrated gate electrode opening on thermally grown oxide. For submicron device fabrication, the need for alignment often leads to a reduced yield.

The other objective of the invention is to provide a method in which the distance from the gate electrode to the electron emissive tip or wedge is much smaller than that can be achieved by prior art fabrication methods. Using the prior art methods, the distance between the emissive electrode and gate electrode is half of the critical dimension of the mask used. With to this invention, field emission devices where the distance between the emissive electrode and gate electrode is less than that achievable by the prior art methods can be constructed using a mask having patterns of a large critical dimension. With a small distance between the gate electrode and the tip of the conical electrode or the edge of the wedge electrode, even a relatively low electric voltage between the two may cause a very high electric field strength. This is desired for field emission. Yet another objective of the invention is to form the gate electrode on high quality, thermally grown oxide so that the electrical leakage between the gate and the substrate is minimum. Still another objective of the invention is to provide a method which requires only simple wet chemical etching to fabricate a field emission device.

The present invention is a very attractive method. At least one tip or wedge electrode is formed on a substrate of monocrystalline silicon by covering the substrate with thermally grown oxide with a small opening. There is a brief etching treatment of the substrate with a small underetching step in the small opening and then a thin film layer is deposited on the entire substrate. A second etching treatment of the substrate in which a tip or wedge structure is formed by means of the thin film layer as a mask in the gate opening region on the substrate. The thin film is then removed before depositing a layer of metal for the gate electrode.

DESCRIPTION OF DRAWINGS

The invention will be described in greater detail with reference to the drawings where.

DETAILED DESCRIPTION OF PREFERRED EMBODIMENTS

(Fabrication Processes for a Tip Emissive Array)

Figure 1:
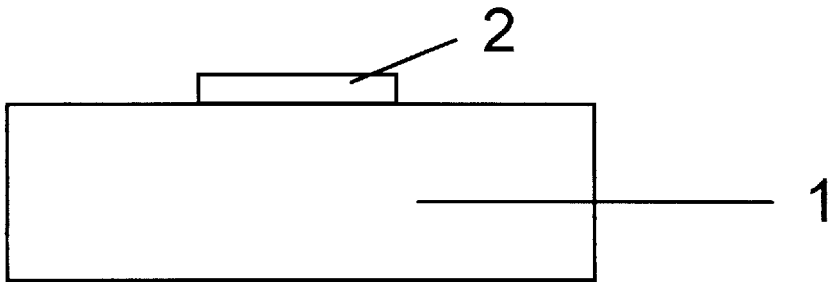
FIGS. 1–4 show the steps of producing a silicon field emission device according to the prior art method.
Figure 2:
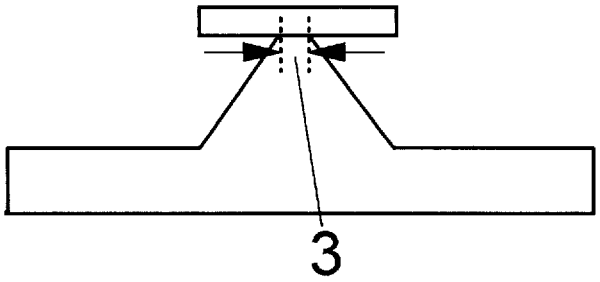
Figure 3:
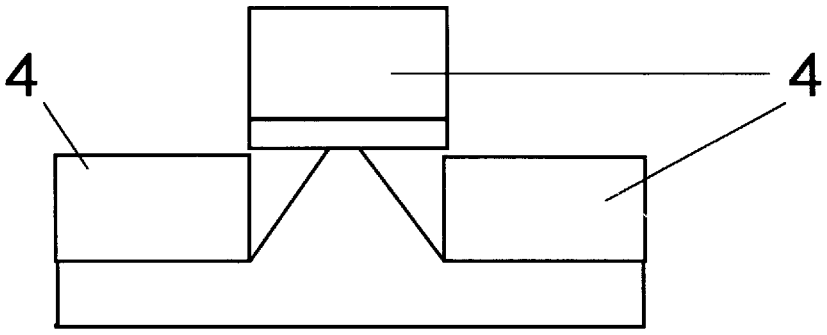
Figure 4:
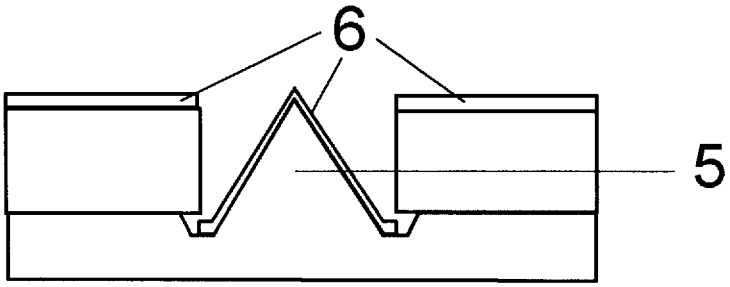
Fig. 4 Prior Art
Figure 5:
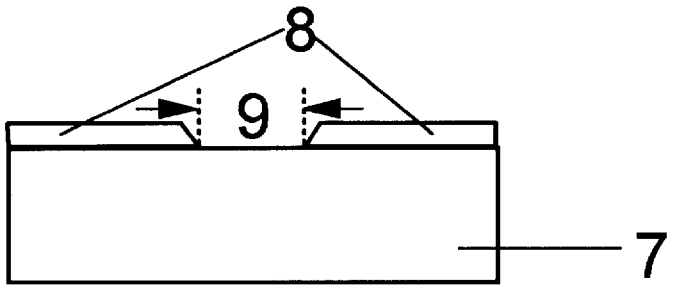
FIG. 5 shows a substrate with thermally grown oxide patterned as the gate opening on the surface.

FIG. 5 shows a substrate, material 7, which, at least near the main face shown, consists of a field emission material and may be selected from a group of semiconductors such as Si, Ge and GaAs. For simplicity, the following description will be made using monocrystalline silicon substrates of n-conductivity type having a crystal orientation such that the main face is a (100) face. This is because monocrystalline silicon substrates having a main face of (100) crystal orientation are readily available from industrial suppliers, such as Virginia Semiconductor, INC. and Addison Engineering, INC. Si substrates with crystal faces other than (100) may also be used to fabricate field emission devices using the methods disclosed in this invention. Referring to FIG. 5, present on the substrate is a layer, 8, of dielectric material which has a first dimension opening, 9, to expose the substrate, 7. The opening may be patterned by photolithography or electron beam lithography. Said layer, 8, preferably consists of silicon dioxide having a thickness of approximately 0.5 $\mu$m which, if desired, may be covered with a layer of silicon nitride of, for example, 0.1 $\mu$m thickness. The critical dimension (CD) of a lithographic process is defined as being the smallest feature one can create on a substrate by using such process.

Figure 6:
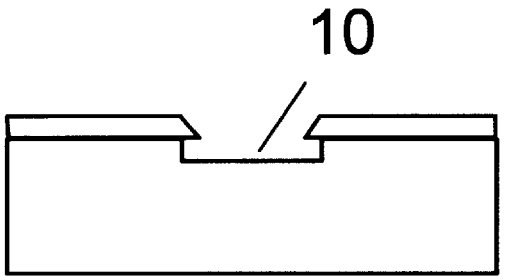
FIG. 6 shows an underetching step at the gate opening region after a brief first etching.

After etching the dielectric material, exposed Si is etched by a first etching step to form a shallow cavity, 10, of a depth of 0.2 $\mu$m. FIG. 6 shows a cross-section of substrate material, 7, after the first etching step in which a shallow cavity, 10, below the dielectric layer, 8, is formed. The etching method may be wet chemical etching, and the solution, which etches isotropically, may be a mixture of nitric acid, acetic acid and hydrofluoric acid with a volume composition of 25 to 10 to 1 at room temperature; or if the solution, etches anisotropically, under the dielectric material layer, 8, the {111 } facets should allow for a 54.7° side angle. The solution may be a mixture of potassium hydroxide and water with a weight composition of 10.5 grams to 14.5 grams at 60° C.

Figure 7:
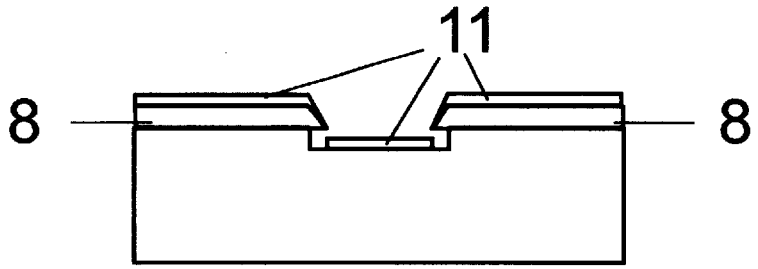
FIG. 7 shows the substrate with a thin film layer deposited on the surface.

After the first etching step, a thin film layer, 11, is vacuum deposited. FIG. 7 shows the thin film layer, 11, which is deposited on the entire surface covering the dielectric material layer, 8, and the central region of the shallow cavity, 10. The thin film layer, 11, having a thickness of 0.1 $\mu$m, may, for example, be a metal like chromium or molybdenum. It is noted that there is a discontinuity between the edge of the thin film layer, 11, on the shallow cavity, 10, and the thin film layer, 11, on the edge of the opening, 9, of the dielectric material layer, 8.

Figure 8:
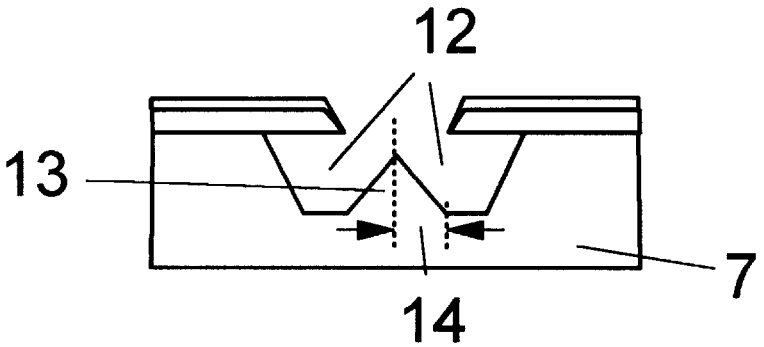
FIG. 8 shows the tip emissive electrode formed under the thin film layer after a second etching, and an embodiment of a field emission device formed according to the invention.

The substrate is subjected to a second etching step. FIG. 8 shows the substrate material, 7, after the second etching, in which a cavity, 12, and a tip electrode, 13, are formed due to the thin film layer, 11, on the central region of the shallow cavity, 10, as an etching mask. This second etching step is stopped as soon as the tip electrode, 13, is formed. Any further etching will lower the height of the tip electrode 13 and hence increase the tip-to-gate distance. This is the first embodiment of the field emission device according to the invention. The etching method may be wet chemical etching, and the solution, which etches isotropically, may be a mixture of nitric acid, acetic acid and hydrofluoric acid with a volume composition of 25 to 10 to 1 at room temperature. It is to be noted that the formation of the tip electrode, 13, by etching starts at the edge of the opening, 9, defined by the dielectric material layer, 8. As a result, the first minimum distance, 14, between the tip of the tip electrode, 13, to the gate electrode, which consists of thin film layer, 11, on dielectric layer, 8, is minimum and may be equal to half of the critical dimension . Using the above described process, there is no need to carry out alignment in order to complete the fabrication. Thus, the method is a self-aligned fabrication process.

Although the above-described process has the advantage of utilizing thermally grown oxide in forming the tip array, the minimum distance between the tip electrode and the gate electrode is approximately equal to half of the critical dimension of the mask needed. In order to fabricate arrays with minimum tip-to-gate distance, photomasks with very small patterns must be used. It would be highly desirable to develop a method that would not require photomask with small patterns.

The following description is of a method which can yield field emission devices and arrays with distance between the emissive electrode and the gate electrode substantially smaller than the critical dimension of the mask needed.

(Fabrication Processes for a Wedge Emissive Array)

Figure 9:
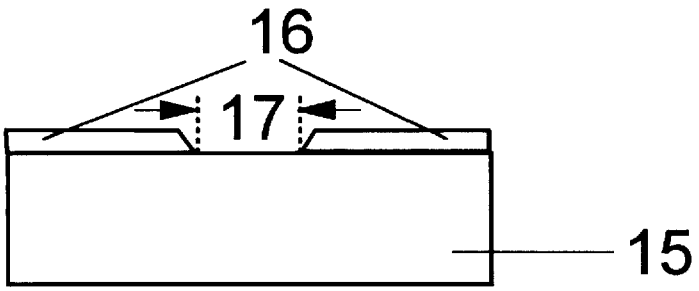
FIG. 9 shows a substrate with thermally grown oxide patterned as the gate opening on the surface.

FIG. 9 shows a substrate material, 15, which, at least near the main face shown, consists of a material for field emission that, may be selected from a group of semiconductors such as Si, Ge and GaAs. For simplicity, the following description will be made using monocrystalline silicon substrates of n-conductivity type having such a crystal orientation that the main face is a (100) face. It is understood that Si substrates with crystal faces other than (100) may also be used to fabricate field emission devices using methods disclosed in this invention.

Referring to FIG. 9, present on the substrate is a layer, 16, of dielectric material which has a first dimension opening, 17, to expose the substrate, 15. The opening may be patterned by photolithography or electron beam lithography. Said layer, 16, preferably consists of silicon dioxide having a thickness of approximately 0.5 $\mu$m which, if desired, may be covered with a layer of silicon nitride of, for example, 0.1 $\mu$m thickness.

Figure 10:
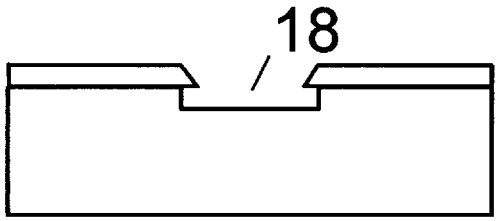
FIG. 10 shows an underetching step at the gate opening region after a brief first etching.

After etching the dielectric material, exposed Si is etched by a first etching step to form a shallow cavity, 18, of a depth of 0.2 $\mu$m. FIG. 10 shows a cross-section of substrate material, 15, after the first etching step in which the shallow cavity, 18, below the dielectric layer, 16, is formed. The etching method may be wet chemical etching, and the solution, which etches isotropically, may be a mixture of nitric acid, acetic acid and hydrofluoric acid with a volume composition of 25 to 10 to 1 at room temperature; or if the solution, etches anisotropically, under the dielectric material layer, 16 , the {111} facets should allow for a 54.7° side angle. The solution may be a mixture of potassium hydroxide and water with a weight composition of 10.5 grams to 14.5 grams at 60° C.

Figure 11:
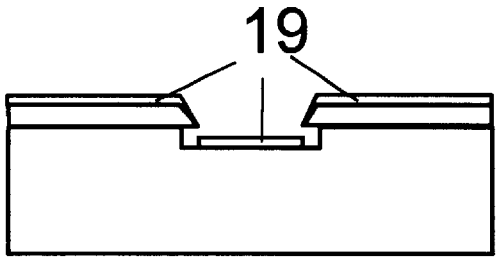
FIG. 11 shows the substrate with a thin film layer deposited on the surface.

After the first etching step, a thin film layer, 19, is vacuum deposited. FIG. 11 shows the thin film layer, 19, which is deposited on the entire surface covering the dielectric material layer, 16, and the central region of the shallow cavity, 18. The thin film layer, 19, having a thickness of 0.1 $\mu$m, may, for example, be a metal like chromium or molybdenum. It is noted that there is a discontinuity between the edge of the thin film layer, 19, on the shallow cavity, 18, and the thin film layer, 19, on the edge of the opening, 17, of the dielectric material layer 16.

Figure 12:
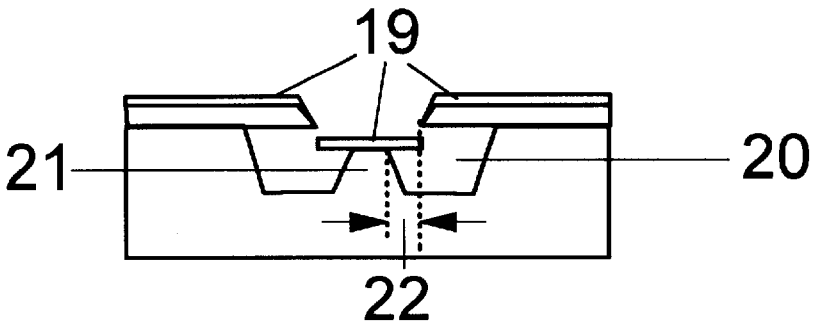
FIG. 12 shows the wedge emissive electrode formed under the thin film layer after a second etching.

The substrate is subjected to a second etching step. FIG. 12 shows an etched substrate material, 15, in which a cavity, 20, and a wedge electrode, 21, are formed under the thin film layer, 19, on the shallow cavity, 18. A second dimension, 22, is the distance between the edge of the wedge electrode, 21, and the edge of the first dimension opening, 19. This second etching step controls the second dimension, 22. The longer this etching, the larger the second dimension, 22. The underetching step under the thin film layer, 19, on the shallow cavity, 18, may be 0.2 $\mu$m. The etching method may be wet chemical etching, and the solution, which etches anisotropically, under the dielectric material layer, 16, the {111} facets should allow for a 54.7° side angle. The solution may be a mixture of potassium hydroxide and water with a weight composition of 10.5 grams to 14.5 grams at 60° C.

Figure 13:
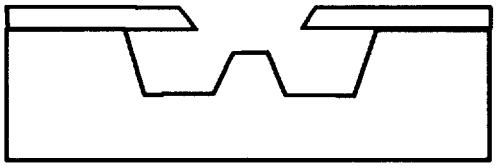
FIG. 13 shows the exposure of the emissive electrode after the thin film layer is removed.
Figure 14:
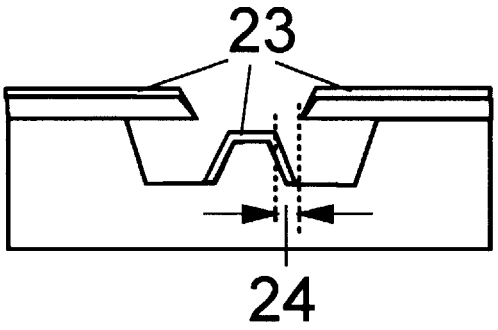
FIG. 14 shows a second embodiment of a field emission device according to the invention after the deposition of metal on the surface according to the invention.

FIG. 13 shows a cross-section after the removal of thin film layer, 19, from the entire surface, with edges of the wedge electrode, 21, exposed. FIG. 14 shows the second embodiment of a field emission device according to the invention after the deposition of thin film layer, 23, which may be a metal, for example, of chromium or molybdenum with a thickness of 0.1 $\mu$m. The thin film layer may also be a polycrystalline silicon. It is to be noted that the formation of the wedge electrode, 21, by etching starts at the edge of the opening, 17, defined by the dielectric material layer, 16. As a result, the second minimum distance, 24 (see FIG. 14), between the edge of the thin film layer, 23, on the wedge electrode, 21, and the gate electrode, which consists of thin film layer, 23, on the dielectric layer, 16, is minimum and may be smaller than half of the critical dimension.

The field emission devices in FIG. 8 and FIG. 14 fabricated according to the invention both have simple constructions. The integrated gate electrode on thin film layer, 11, in FIG. 8 and 23 in FIG. 14 are positioned at an extremely short distance from the tip electrode, 13, in FIG. 8 and wedge electrode, 21, in FIG. 14. As a result of this, a strong electric field can be generated readily with a comparatively low voltage, for example, a few hundred volts between the two, which field is necessary to obtain an emission of electrons from the emissive electrodes.

It is to be noted that the substrate material need not be silicon. The starting material may also be, for example, a composite material in which tip and wedge electrodes are formed. Furthermore, the dielectric material layer may alternatively consist of a material other than those mentioned, for example, aluminum oxide.

It is also to be noted that the invention is not restricted to wet chemical etching. Various etching methods, for example, reactive ion etching or plasma etching, may be used to create the underetching step at the first etching and the formation of the emitter electrode at the second etching.

It is further to be noted that an emitter sharpening step can be added to improve the performance of tips or wedges produced according to the invention. This step involves a dry oxidation of the sample with a tip or wedge emitter for, for example, 2 hours at 1100° C. The oxide is then removed by buffered HF solution. This sharpening step is carried out after the formation of the tip or wedge electrode shown in FIG. 8 and FIG. 13.

What is claimed is:

1. A method of forming a field emission tip device on a silicon semiconductor substrate with self-aligned gate structure comprising:

deposition of an insulating layer, selective etching of said insulating layer to form at least one window with a first dimension, first selective etching of said silicon semiconductor to form an etched step and to undercut said window, deposition of a metal layer over said insulating layer to form a self-aligined gate and to cover said silicon semiconductor substrate within the window, second selective etching of said silicon semiconductor to form a tip with a first distance between said tip and said gate.

2. A method of forming a field emission device as defined in claim 1 wherein said insulating layer is formed by thermal oxidation.

3. A method of forming a field emission device as defined in claim 1 wherein thickness of said metal layer is less than the height of said etched step in said window.

4. A method of forming a field emission device as defined in claim 1 wherein said first distance is half of the first dimension.

5. A method of forming a field emission device as defined in claim 1 further comprising a step of sharpening said tip formed in said window.

6. A method of forming a field emission wedge device on a silicon semiconductor substrate comprising:

deposition of an insulating layer, selective etching of said insulating layer to form at least one window with a first dimension, first selective etching of said silicon semiconductor to form an etched step and to undercut said window, deposition of a first metal layer over said insulating layer and window, second selective etching of said silicon semiconductor to form an wedge emitter having an edge spaced a second dimension from edge of said window, etching of said first metal layer, deposition of a second metal layer over said insulator to form a self-aligined gate and over said wedge emitter to form an emission device having an emissive edge space from the gate by a first distance.

7. A method of forming a field emission wedge device as defined in claim 6 wherein said insulating layer is formed by thermal oxidation.

8. A method of forming a field emission wedge device as defined in claim 6 wherein thickness of said first metal layer is less than height of said etched step in said window.

9. A method of forming a wedge field emission device as defined in claim 6 further comprising a step of sharpening said wedge emitter formed in said window.

10. A method of forming a field emission wedge device as defined in claim 6 wherein said second dimension and the first distance are substantially smaller than one half of said first dimension so that a conventional lithographic process may be used to form said window.

* * * * *